United States Patent [19]

Best

[11] 3,994,383

[45] Nov. 30, 1976

[54] STUFFED RIBBON CARTRIDGE

[75] Inventor: Robert L. Best, Jackson, Tenn.

[73] Assignee: NCR Corporation, Dayton, Ohio

[22] Filed: Feb. 5, 1975

[21] Appl. No.: 547,426

[52] U.S. Cl. ..... 197/168; 197/151; 197/170

[51] Int. Cl.[2] ..... B41J 33/14

[58] Field of Search ..... 197/151, 168, 170

[56] References Cited

UNITED STATES PATENTS

| | | | |
|---|---|---|---|
| 3,578,137 | 5/1971 | Salto | 197/170 |
| 3,726,381 | 4/1973 | Murphy | 197/151 |
| 3,758,012 | 9/1973 | Bonner et al. | 197/168 |
| 3,863,749 | 2/1975 | Perry et al. | 197/168 |
| 3,897,866 | 8/1975 | Mueller | 197/170 |

FOREIGN PATENTS OR APPLICATIONS

| | | | |
|---|---|---|---|
| 12,870 | 6/1913 | United Kingdom | 197/168 |
| 29,235 | 12/1913 | United Kingdom | 197/168 |

OTHER PUBLICATIONS

IBM Tech. Disclosure Bulletin, vol. 13, No. 11, Apr. 1971, p. 3324, Reversible Endless Tape Cassette, C. E. Owen.

IBM Tech. Disclosure Bulletin, vol. 15, No. 2, July 1972, p. 543, Endless Fold Ribbon cartridge B Gardineer Jr.

*Endless Ribbon Feed*, Bergers et al., IBM Technical Disclosure Bulletin, vol. 7, No. 12, May 1965, p. 1212.

*Primary Examiner*—Clifford D. Crowder
*Assistant Examiner*—William Pieprz
*Attorney, Agent, or Firm*—J. T. Cavender; Albert L. Sessler, Jr.; Elmer Wargo

[57] ABSTRACT

A divider or organizer is located within a ribbon cartridge between the entrance and exit areas thereof to facilitate the flow of an endless ribbon through the cartridge. The divider, in cooperation with an end wall of the cartridge, form an area which diverges away from the entrance area and also form an area which converges towards the exit area to facilitate the flow of the ribbon through the cartridge. A ribbon guiding section formed on the cartridge to change the path of the ribbon in several planes substantially perpendicular to one another enables the cartridge to be compact.

3 Claims, 6 Drawing Figures

STUFFED RIBBON CARTRIDGE

BACKGROUND OF THE INVENTION

This invention relates to an improved to an improved, stuffedribbon cartridge for use in business machines.

A stuffed-ribbon cartridge is of the type which has about fifteen yards of inked ribbon formed into an endless loop which is stuffed into the cartridge to form a plurality of random convolutions or folds of ribbon therein. The cartridge forms a means for supplying fresh ribbon to a print station in the business machine in which the cartridge is used and for quickly changing the ribbon in the machine without ever having to manipulate or touch the ribbon.

Some ribbon cartridges representative of the prior art are shown in the U.S. Pats. Nos. 3,814,231, and 3,830,351.

One of the problems with prior art ribbon cartridges is that the strand of ribbon exiting from the exit area of the cartridge will drag therewith several convolutions of ribbon. If enough convolutions of ribbon jam up at the exit area, the exit area can become clogged, causing the tension on the ribbon being pulled out of the cartridge to increase, resulting in possible fraying or breaking of the ribbon.

Another problem with the ribbon cartridges of the prior art is that the cartridges usually have a ribbon guiding means which is quite long, making the cartridge bulky. The ribbon guiding means directs the path of ribbon travel from a storage chamber in the cartridge to a print station (in a machine in which the cartridge is used), and returns the ribbon to the storage chamber of the cartridge.

In contrast with the ribbon cartridges of the prior art, the cartridge of this invention utilizes a divider or organizer means to effect a better flow of the convolutions or folds of the ribbon through the storage chamber of the cartridge. The cartridge of this invention also has an improved ribbon guiding means for directing the ribbon travel in a compact manner from the storage chamber of the cartridge to a print station and back to the storage chamber so as to produce a compact cartridge. This feature is especially useful when using the cartridge on a business machince where compactness is required. As an illustration of the use of this invention, it can be used in a business machine like an accounting machine which employs a wire matrix printer.

SUMMARY OF THE INVENTION

This invention relates to a cartridge of the stuffed-ribbon type which includes a storage chamber having a floor, a ceiling, and an end wall joining the floor and ceiling, for storing a ribbon therein. The chamber has an entrance area and an exit area for feeding the ribbon into and out of the chamber, respectively. A divider means is positioned in the chamber between the entrance and exit areas thereof to facilitate the movement of the ribbon into and out of the chamber, respectively. The divider means in cooperation with the end wall of the cartridge form an area which diverges away from the entrance area and also form an area which converges towards the exit area to also facilitate the flow of the ribbon through the cartridge.

A ribbon guiding means formed on the cartridge to change the path of the ribbon in several planes substantially perpendicular to one another enables the cartridge to be compact in shape and size.

Various stripping means associated with feed wheels and the divider means of this invention also facilitate the flow of the ribbon through the storage chamber of the cartridge.

A fuller understanding of this invention can be realized by referring to the description and claims taken in conjunction with the accompanying drawing.

BRIED DESCRIPTION OF THE DRAWING

DETAILED DESCRIPTION OF THE INVENTION

Figure 1:
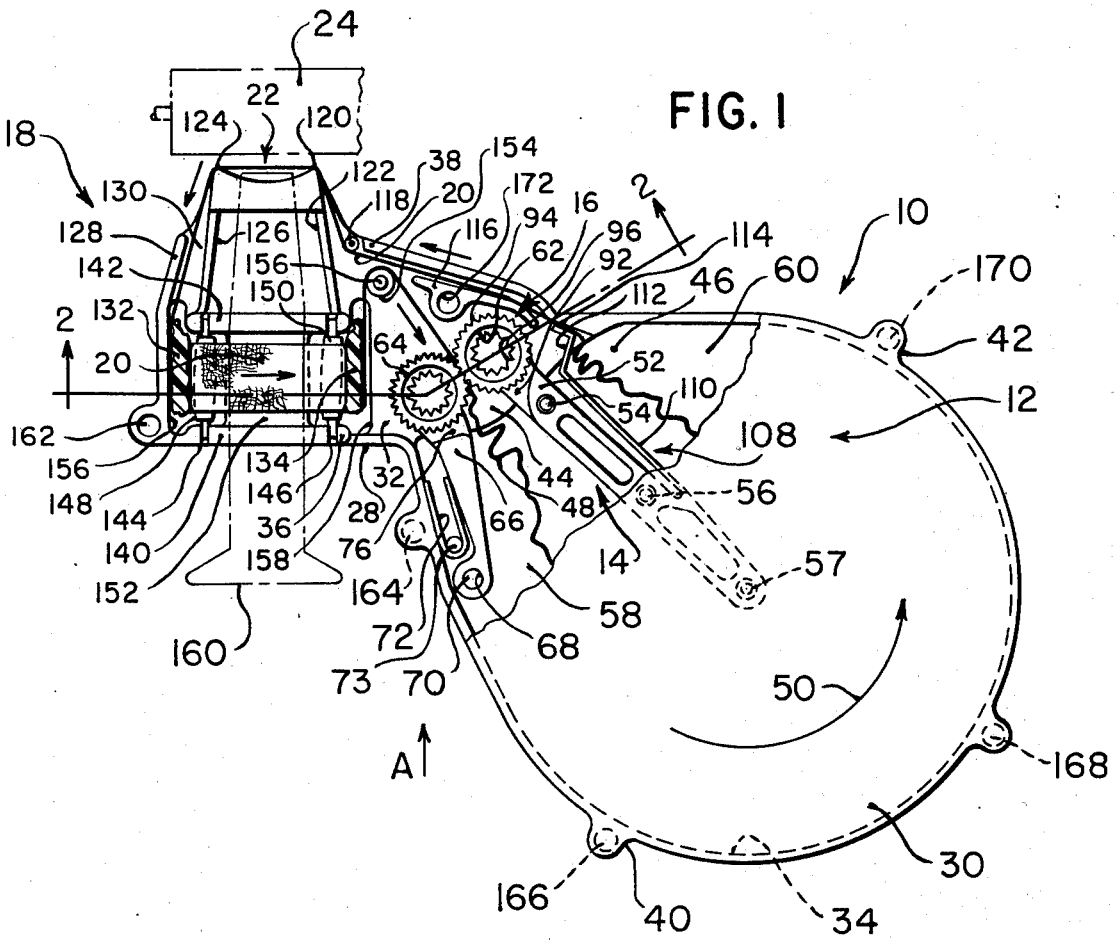
FIG. 1 is a plan view of a ribbon cartridge embodying the principles of this invention, with portions of a cover of the cartridge being removed to show a ribbon storage chamber and a divider means located therein, a ribbon feed means, and a ribbon guiding means located externally of the storage chamber.

FIG. 1 is a plan view of a ribbon cartridge embodying the principles of this invention and is designated generally as 10. The cartridge 10 generally includes a ribbon storage chamber 12, an organizer or divider means 14 located within the chamber 12, a ribbon feed means 16, and a ribbon guiding means 18 for guiding a ribbon 20 from the chamber 12 to a print plane 22 next to a platen 24 of a business machine 26 in which the cartridge 10 is used, and for guiding the ribbon 20 back to the ribbon feed means 16 which feeds or stuffs the ribbon 20 back into the chamber 12.

As seen from FIS. 2 and 3, the cartridge 10 is made up of a body portion 28 and a cover portion 30 which are designed to fit together in the assembled relationship shown, without the use of any separate fasteners. The body portion 28 and cover portion 30 are made from a high impact polystyrene material by a conventional injection molding process.

The body portion 28 has a floor 32 which has a general pear shape as shown in FIG. 1, and has an end wall 34 perpendicularly upstanding therefrom. The end wall 38 extends from a point 36 near the feed means 16, around the entire perimeter of the floor 32 to a point 38 near the print plane 22. From the ribbon feed means 16, the opposed sides of the wall 34 diverge away from each other until they reach points 40 and 42 and thereafter they meet, forming a semi-circular wall.

The storage chamber 12 (FIG. 1) has an entrance area 44 into which the ribbon 20 is fed and an exit area 46 from which the ribbon 20 exits to the ribbon guiding means 18, and the divider means 14 is positioned between said entrance and exit areas 44, 46 and is aligned towards the center of the chamber 12 along a generally radial line therein, and extends towards the center of the chamber 12. As the ribbon 20 is fed into the entrance area 44, it is formed into a plurality of folds or convolutions 48 (only a few of which are shown to simplify the drawing) and the general flow of the ribbon 20 through the compartment 12 is shown by the arrow 50. As started earlier, the ribbon 20 is formed of a length of about 15 yards of inked ribbon whose ends are conventionally joined to form the endless ribbon 20. The ribbon 20 travels through the chamber 12 on its edge, and the height of the chamber 12 as measured between the floor 32 of the chamber and the cover portion 30 is slightly greater than the width of the ribbon 20 to facilitate its movement therethrough.

The divider means 14 consists of a bar member 52 having mounting holes therein which reeceive pins 54, 56 and 57 which are integrally formed with the body portion 28 and are perpendicularly upstanding therefrom to hold the divider means 14 in the position shown in FIG. 1. The divider means 14 and the end wall 34 diverge away from each other at the entrance area 44 to form a first area 58 in said chamber 12, and the divider means 14 in cooperation with the end wall 34 converge towards each other at the exit area 46 to form a second area 60 in said chamber. The functions of these areas 58 and 60 will be described after a discussion of the ribbon feed means 16.

Figure 6:
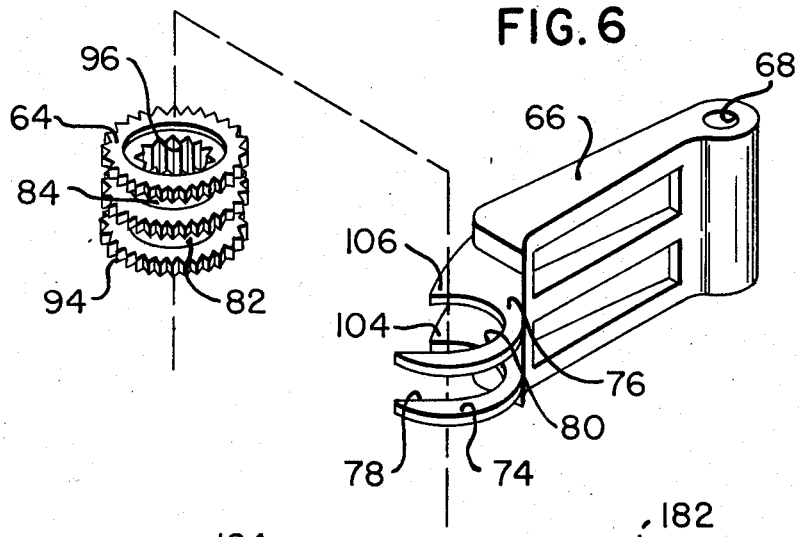
FIG. 6 is an enlarged, exploded view of an idler wheel and supporting arm which are part of the ribbon feed means.

The ribbon feed means 16 (FIG. 1) includes a driven gear 62 which is rotatably mounted on an end of the bar member 52 and an idler gear 64 which is rotatably supported on one end of an arm 66 whose remaining end has a hole 68 therein for pivotally mounting the arm 66 on a pin 70 which is integrally formed with the body portion 28 and perpendicularly upstanding therefrom. A U-shaped, steel spring 72, compressed between the wall 34 and the arm 66 and retained by a pin 73 upstanding from the body position 28, resiliently biases the arm 66 towards the divider means 14 so as to maintain the idler gear 64 in resilient engagement with the driven gean 62. The arm 66 has a pair of spaced, parallel, crescent-shaped sections 74 and 76 thereon (FIG. 6) which are cut out to produce mounting notches 78 and 80 therein, respectively, to rotatably receive the gear 64. The gear 64 has two spaced annular recesses 82 and 84 formed thereon which are complementary to the sections 74 and 76 to enable the gear 64 to be rotatably mounted on the arm 66, and retained thereon. When assembled as shown in FIG. 1, the open ends of the mounting notches 78 and 80 face the driven gear 62. The gear 62 is identical to gear 64 just described and has annular recesses 86 and 88 (FIG. 2) therein which cooperate with crescentshaped sections 90 and 92 (FIG. 2) (similar to sections 74 and 76) which extend from the bar member 52, to rotatably mount the gear 62 on the sections 92 and 94 and retain it thereon. The mounting notches (not shown) on the sections 90 and 92 have their open ends facing the gear 64 so that when ribbon feed means 16 is in the assembled relationship shown in FIG. 1, the gears 62 and 64 are resiliently kept in engagement with each other and the teeth 94 thereon feed the ribbon 20 into the chamber 12 whenever the gear 62 is rotated. The gear 62 has a splined inner diameter 96 which is aligned with a hole 98 in the body portion 28, through which hole 98 a splined or square driving shaft 100 (FIG. 3) passes to drivingly rotate the gear 62 (in a counterclockwise direction as viewed in FIG. 1) when the cartridge is mounted on a business machine 26 and used therewith. The lower side of the body portion 28 has an annular lip 102 surrounding the hole 98, which lip fits into a complementary hole in the machine 26 so as to facilitate the mounting of the cartridge 10 on the machine 26. The cartridge 10 can be tilted (as viewed in FIG. 3 by conventional structure not shown but associated with the machine 26) to enable the cartridge 10 to print in two colors when a two color ribbon is used in the cartridge 10.

As the gear 62 (FIG. 1) is rotated, the ribbon 20 is squeezed between the gears 62 and 64 and is fed into the entrance area 44 and formed into the folds or convolutions 48 shown, and a portion of the ribbon 20 is pulled out of the cartridge 10 from the exit area 46, to feed a fresh supply of the ribbon to the print plane 22.

As the ribbon 20 is fed into the entrance area 44, the design of the chamber 12 facilitates the movement of the ribbon 20 therethrough. As stated earlier herein, the divider means 14 and the end wall 34 form the first area 58 which diverges away from the entrance area 44 to thereby minimize the stuffing pressure which exists when the ribbon 20 is fed into the chamber 12. The sections 74, 76, 90 and 92, also have stripping edges 104, 106 like those shown on sections 74 and 76, respectively, in FIG. 6 to strip the ribbon 20 from the gears 62 and 64, to thereby facilitate the feeding of the ribbon 20 into the chamber 12 and to prevent the ribbon 20 from rewinding around or binding to one of the gears 62, 64.

As the convolutions 48 of the ribbon 20 are fed into the first area 58, they travel around the innermost end of the divider means 14 in the chamber 12 in the direction of the arrow 50 (FIG. 1) until they approach the second area 60. At this second area 60 the divider means 16 and the end wall 34 converge towards the exit area 46 so as to also facilitate the flow of the ribbon 20 through the chamber 12 by minimizing the tension on the ribbon 20. Because of the orderly flow of the convolutions 48 of the ribbon 20 through the chamber 12, due to the divider means 14 and the shape of the chamber 12, those convolutions 48 of the ribbon which are next due to be drawn through the exit area 46 are close to it, thereby minimizing tension on the ribbon 20.

The divider means 14 also has a stripping means 108 secured thereto to facilitate the movement of the ribbon 20 out of the chamber 12 by eliminatng the convolutions 48 therein. The stripping means 108 includes a leaftype spring 110 having one end thereof integrally formed on and near one end of the bar member 52, and the other end of the spring 110 has a foot portion 112 formed thereon as shown in FIG. 1. The leaf spring 110 resiliently biases the foot portion 112 against a flat portion 114 on the end wall 34 so as to resiliently compress the ribbon 20 therebetween and eliminate the convolutions 48 of the ribbon 20 as the ribbon passes out of the chamber 12.

As the ribbon passes out of the chamber 12, it is guided to the print station 22 (FIG. 1) by the ribbon guiding means 18 alluded to earlier herein. The ribbon 20 passes in a channel formed by the end wall 34 and a wall 116 integrally formed with the body portion 28 and perpendicularly upstanding therefrom, and then passes around a roller 118 whose ends are pivotally mounted in appropriate, aligned holes located in the body portion 28 and the cover portion 30 of the cartridge 10. The roller 118 is positioned near point 38 where the end wall 34 terminates so as to enable the ribbon 20 to emerge from the cartridge 10. From the roller 118, the ribbon 20 passes around a curved end 120 (FIG. 3) of a wall 122 (FIG. 1) which is integrally formed with the body portion 28 and perpendicularly upstanding therefrom as shown in FIG. 1.

From the curved end 120, the ribbon 20 (FIG. 1) passes around a curved end 124 (identical in profile to end 120) formed on the end of a wall 126. A second wall 128, spaced from wall 126 but integrally connected thereto by a joining floor portion 130, form a channel for the ribbon 20. That which has been described so far of the ribbon guiding means 18, describes a first guide means for guiding the ribbon 20 to print plane 22 in which the ribbon 20 is positioned substantially perpendicular to the floor 32 of the cartridge 10.

Figure 5:
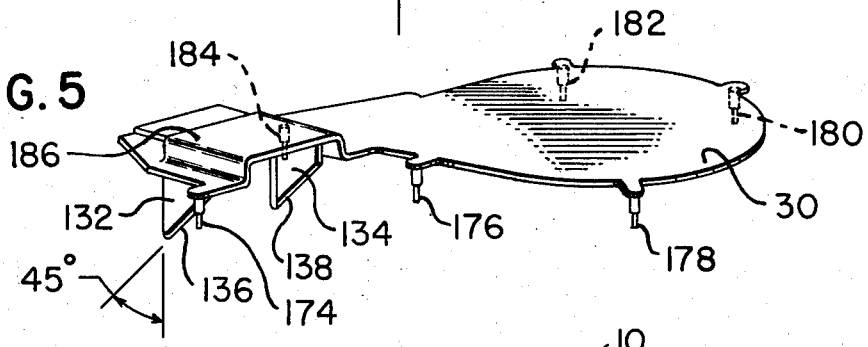
FIG. 5 is a perspective view of the cover of the cartridge, looking at the top of the cover, to show a portion of the ribbon guiding means.
Figure 4:
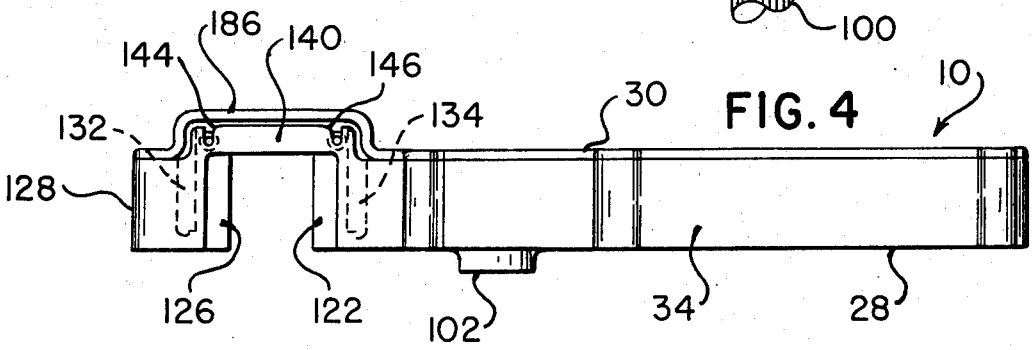
FIG. 4 is an elevational view of the cartridge as seen from the direction A of FIG. 1.

In order to achieve compactness of the ribbon guiding section 18, there is provided a second guide means which receives the ribbon 20 from the first guide means just described, and guides the ribbon in a plane which is parallel to the floor 32. To effect this change in direction, the lower side of the cover portion 30 has two spaced, parallel sections 132 and 134 integrally formed therewith, and depending perpendicularly therefrom as shown in FIG. 5. The sections 132 and 134 each have a 45° angle formed on the lowr edges 136 and 138, respectively, and these edges are rounded to permit the ribbon 20 to easily glide thereover. The second wall 128 has a joining section 140 integrally formed therewith as shown in FIGS. 1 and 4 to join the wall 128 with the end wall 34 at point 36. A second joining section 142 integrally joins the inner wall 126 with the wall 122 as shown in FIG. 1. The joining sections 140 and 142 are formed in spaced, parallel relationship with each other and have aligned notches 144, 146 (FIGS. 1 and 4) therein to receive rollers 148 and 150 which are rotatably mounted therein in spaced, parallel relationship with each other. A reinforcing wall 152 interconnects the joining sections 140 and 142 to reinforce the ribbon guiding means 18.

When the cover portion 30 is positioned on the body portion 28 in assembled relationship therewith, the sections 132 and 134 on the underside of the cover portion 30 provide a direction changing means for the ribbon 20. As the ribbon 20 passes around the lower edge 136 of section 132, it changes direction and is directed over the roller 148 (FIGS. 2) and roller 150 so that the ribbon 20 is substantially parallel to the plane of the floor 32 of the cartridge 12 when travelling between the rollers 148 and 150.

The ribbon guiding section 18 also includes a third guide means which receives the ribbon 20 from the roller 150 and changes its direction to one which is perpendicular to the floor 32 of the cartridge 10 and returns the ribbon 20 to the ribbon feed means 16. The third guide means includes the section 134, depending from the cover portion 30, and a roller 154 which is rotatably mounted on a pin 156 (FIG. 1) whose ends are supported in aligned holes in the body portion 28 and cover portion 30. From the roller 150, the ribbon travels around the lower edge 138 of section 134, around the roller 154 and between the gears 62 and 64 of the ribbon feed means 16. There are slots 156 and 158 in the floor portions 130 and the floor 32, respectively, to provide a clearance for the sections 132 and 134 and to provide adjustment of the ribbon 20 on the sections 132 and 134 should that become necessary when the cover portion 30 is placed on the body portion 28.

Figure 2:
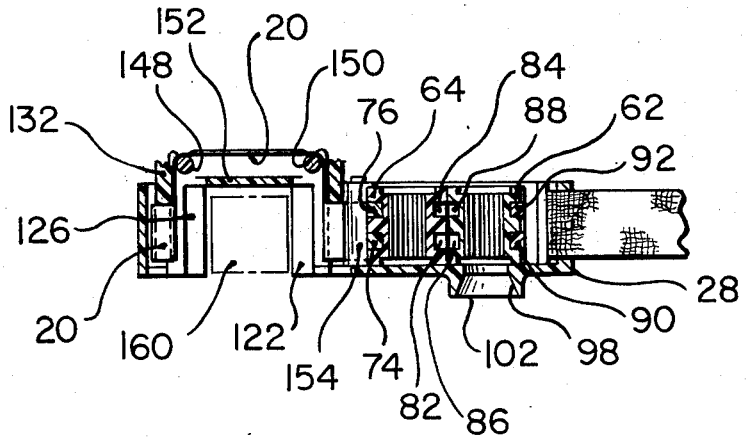
FIG. 2 is a cross-sectional view, taken along the line 2—2 of FIG. 1. to show additional details of this invention.
Figure 3:
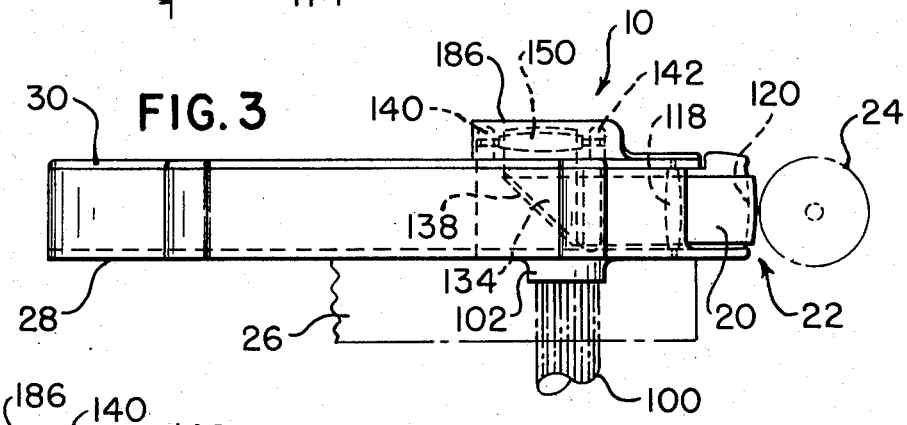
FIG. 3 is a side view, in elevation, of the assembled cartridge, as seen from the right side of FIG. 1, showing its relationship to a business machine when used in conjunction therewith.

The compact design of the cartridge 10 enables a print head 160 of the wire matrix variety, for example, to be inserted between the walls 122 and 126 of the ribbon guiding means 18 as shown in FIGS. 1 and 2.

the body portion 28 of the cartridge 10 has a plurality of holes 162, 164, 166, 168, 170 and 172 (FIG. 1) formed therein to receive the pins 174, 176, 178, 180, 182 and 184 (FIG. 5) respectively, (depending from the cover portion 30) when the cover portion 30 is assembled on the body portion 28. The cover portion 30 has a raised section 186 (FIGS. 3 and 4) to provide a clearance for the rollers 148 and 150 and the ribbon 20. With the construction described, the cartridge 10 may be completely made of plastic material as described, except for the metal spring 72, and can be conveniently assembled by hand without separate fasteners, to provide a low-cost, compact throw-away cartridge.

What is claimed is:

1. A cartridge of the stuffed-ribbon type comprising:

a storage chamber having a floor, a ceiling, and an end wall joining the floor and ceiling for storing a ribbon therein;

an entrance area and an exit area in said chamber through which said ribbon passes into and out of said chamber respectively; and a divider means positioned in said chamber between said entrance and exit areas to facilitate the movement of said ribbon into and out of said chamber, respectively;

said entrance and exit areas being located on opposed sides of said divider means and being partially formed thereby;

said divider means having first and second ends, with said second end extending into said chamber towards the center thereof to form first and second areas in said chamber, and said first end being located between said entrance and exit areas; and further comprising:

a ribbon feed wheel means rotatably mounted within said cartridge on said first end of said divider means and means for rotating said feed wheel means; and an idler wheel and support means located within said cartridge for resiliently biasing said idler wheel towards said feed wheel means so as to feed said ribbon therebetween into said first area of said chamber;

said support means comprising:

a support lever having first and second ends with said second end being pivotally mounted in said chamber and said idler wheel being rotatably mounted on said first end;

at least one of said first ends of said divider means and said support lever having stripper means integrally formed therewith to facilitate the movement of said ribbon into said first area of said chamber;

said support lever and said divider means diverging away from each other so as to facilitate the movement of said ribbon into said first area of said chamber; and said divider means having a resilient stripping means connected thereto and integrally formed therewith to eliminate folds in said ribbon as it approaches said exit area.

2. A cartridge of the stuffed-ribbon type comprising:

a body portion and a cover portion;

said body portion having a floor and an end wall to form a storage chamber for a ribbon;

said cover portion forming a ceiling for said chamber;

an entrance area and an exit area in said chamber through which said ribbon passes into and out of said chamber respectively;

a divider means positioned in said chamber between said entrance and exit areas to facilitate the movement of said ribbon into and out of said chamber, respectively;

said divider means having a resilient stripping means connected thereto to eliminate folds in said ribbon as it approaches said exit area;

ribbon feed means at said entrance area for feeding said ribbon into said chamber so that the width of the ribbon is perpendicular to said floor and ceiling; and a ribbon guiding section being shaped to receive a print means and to guide said ribbon from said exit area past a print plane relative to said print means and to return said ribbon to said entrance area;

said ribbon guiding section also being shaped for guiding said ribbon around said print means in three planes which are substantially perpendicular to one another to provide a compact cartridge; said ribbon guiding section comprising:

first guide means integrally formed with said body portion for receiving said ribbon from said exit area and for guiding said ribbon in said print plane which is substantially perpendicular to the plane of said floor;

second guide means for receiving said ribbon from said first guide means and for guiding said ribbon in a second plane which is parallel to the plane of said floor; and third guide means for receiving said ribbon from said second guide means and for guiding said ribbon in a third plane which is perpendicular to the plane of said floor, and for returning said ribbon to said ribbon feed means at said entrance area;

at least a portion of said second guide means and said third guide means being located in said cover portion and being integrally formed therewith:

3. A cartridge of the stuffed ribbon type, comprising:

a body portion and a cover portion;

said body portion having a floor and an end wall to form a storage chamber;

said cover portion forming a ceiling for said storage chamber;

an endless ribbon stored in said chamber;

an entrance area and an exit area in said chamber through which said ribbon passes into and out of said chamber respectively;

a divider means positioned in said chamber between said entrance area and said exit area to extend into said chamber to form first and second areas in said chamber, with said end wall and said divider means diverging away from each other at said entrance area and said end wall and said divider means converging towards each other at said exit area;

said divider means having a resilient stripping means connected thereto to eliminate folds in said ribbon as it approaches said exit area;

said cartridge further comprising:

a ribbon guiding section being shaped to receive a print means and to guide said ribbon from said exit area past a print plane relative to said print means and to return said ribbon to said entrance area; and feed means for feeding said ribbon into said chamber;

said ribbon guiding section having means thereon for guiding said ribbon around said print means in three planes which are substantially perpendicular to one another to provide a compact cartridge, and being integrally formed with said cartridge;

said guiding means of said ribbon guiding section including first and second sections secured to said cover portion in spaced parallel relationship with each other, with each said first and second section having a guiding edge placed at 45° to said cover portion over which guiding edges said ribbon passes.

* * * * *